United States Patent [19]

Shulyak

[11] 4,219,958

[45] Sep. 2, 1980

[54] HINGEDLY CONNECTED TRIANGULAR ELEMENTS

[75] Inventor: Lev Shulyak, Worcester, Mass.

[73] Assignee: Norman S. Blodgett, Worcester, Mass.

[21] Appl. No.: 966,114

[22] Filed: Dec. 4, 1978

[51] Int. Cl.[2] ..... A63H 33/00

[52] U.S. Cl. ..... 46/1 R; 46/29

[58] Field of Search ..... 46/1 R, 16, 17, 29, 46/31; 35/72; 63/3, 4, 7–9; 59/83; 245/4, 9; 16/192; 273/155

[56] References Cited

U.S. PATENT DOCUMENTS

| | | | |
|---|---|---|---|
| 190,171 | 5/1877 | Walker . | |
| 236,124 | 12/1880 | Washburn | 16/192 |
| 237,490 | 2/1881 | Coonley | 59/83 |
| 257,765 | 5/1882 | Rowe . | |
| 3,271,895 | 9/1966 | Sorensen | 46/31 |
| 3,353,774 | 11/1967 | Thomas | 248/68 |
| 3,662,486 | 5/1972 | Freedman | 46/1 R |
| 3,900,984 | 8/1975 | Garelick | 46/1 R |
| 3,916,559 | 11/1975 | Flowerday | 46/1 R |
| 4,063,585 | 12/1977 | Stanley | 160/135 |

FOREIGN PATENT DOCUMENTS

| | | | |
|---|---|---|---|
| 41316 | 9/1965 | German Democratic Rep. | 35/34 |

*Primary Examiner*—F. Barry Shay

*Attorney, Agent, or Firm*—Norman S. Blodgett; Gerry A. Blodgett

[57] ABSTRACT

Apparatus for use as a toy, consisting of an endless band formed of wire triangles alternately arranged and hingedly connected.

6 Claims, 7 Drawing Figures

(BRIDGE)

(RADAR ANTENNA)

"PUPPY"

HINGEDLY CONNECTED TRIANGULAR ELEMENTS

BACKGROUND OF THE INVENTION

One of the most popular classes of children's toys are those known as "construction sets", consisting of elements that can be joined to form models of bridges, buildings and the like. Among these are the so-called "TINKERTOY" and the "ERECTOR" set. In most cases they consist of a large number of straight elements and a large number of connectors allowing the straight elements to be joined rigidly in various three-dimensional patterns. The delightful aspect of such construction toys is that, not only are they entertaining to children of all ages, but there is a decided educational aspect that stimulates three-dimensional visualization and promotes mechanical apptitude. One of the less desirable aspects of such construction sets, however, is that, because they consist of so many small parts, the elements tend to become lost or in any case separated from the set. In the case of a very young child, such sets are undesirable, since they can be inserted in the mouth, ear, eye, and the like and are, in general, unsafe. Nevertheless, it is still desirable that even very young children be stimulated at this impressionable age by toys that have an educational aspect. These and other difficulties experienced with the prior art devices have been obviated in a novel manner by the present invention.

It is, therefore, an outstanding object of the invention to provide a construction apparatus consisting of a number of elements non-detachably joined to form a unitary figure.

Another object of this invention is the provision of a construction apparatus which is useful as a toy, as well as a construction and educational device, and which has no loose parts to present a safety hazard to very young children.

A further object of the present invention is the provision of a construction apparatus, consisting of a plurality of elements hingedly joined to form an endless band which can be twisted, pressed, and otherwise shaped into a large number of possible three-dimensional geometric shapes.

It is another object of the instant invention to provide a toy which is simple in construction, which is inexpensive to manufacture, and which is capable of a long life of useful service with a minimum of maintenance.

A still further object of the invention is the provision of a construction toy having a chain-like configuration with no loose parts to become mislaid, but which is capable of being deformed into a large number of imaginative three-dimensional patterns.

With these and other objects in view, as will be apparent to those skilled in the art, the invention resides in the combination of parts set forth in the specification and covered by the claims appended hereto.

SUMMARY OF THE INVENTION

In general, the invention consists of a construction apparatus having a first triangular element formed of a rod-like material and a second triangular element which is similar to the first triangular element and which has one side extending along and contacting one side of the other first triangular element. A connector joins the two contacting sides to permit relative rotation of the two triangular elements about an axis along the line of contact of the said two sides.

More specifically, the connector is a sleeve formed of an elastomeric material and the triangular elements are formed of steel wire. Each triangular element consists of three straight wire side members of equal length, at least two adjacent side members being joined by a tubular elastomer connector. A plurality of similar triangular elements are joined in alternate arrangement to form an endless band.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
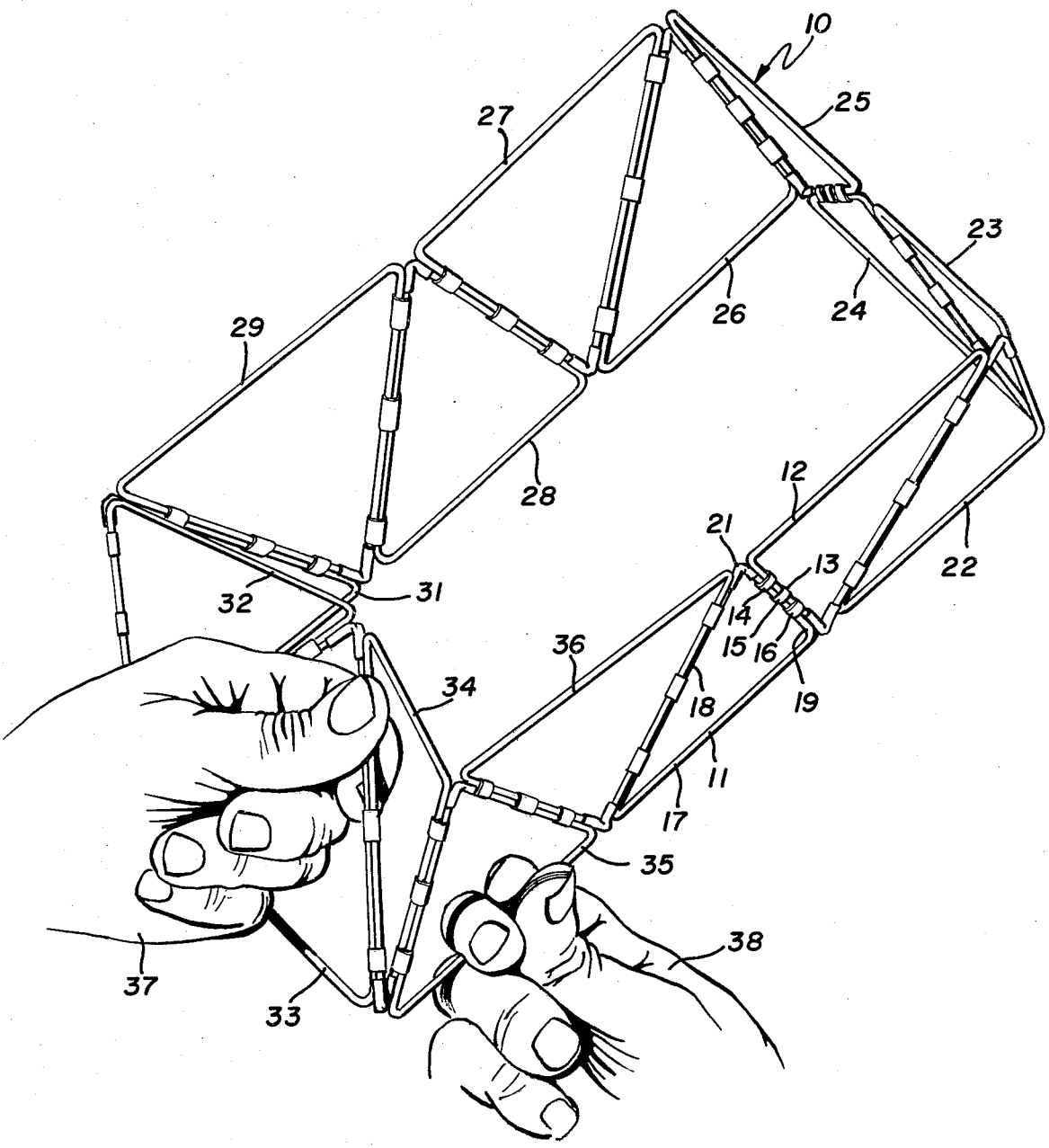
FIG. 1 is a perspective view of a construction apparatus embodying the principles of the present invention.

Referring first to FIG. 1, wherein are best shown the general features of the invention, a construction apparatus, indicated generally by the reference numeral 10, is shown as including a first triangular element 11 formed of a rod-like material such as steel wire and a second triangular element 12 which is similar to the first triangular element. One side of the triangular 12 is in contact with one side of the triangular element 11 in reversed or alternate arrangement. Connecting means 13 joins the two contacting sides to permit relative rotation of the two triangular elements about an axis along the line of contact of the said two sides.

Figure 2:
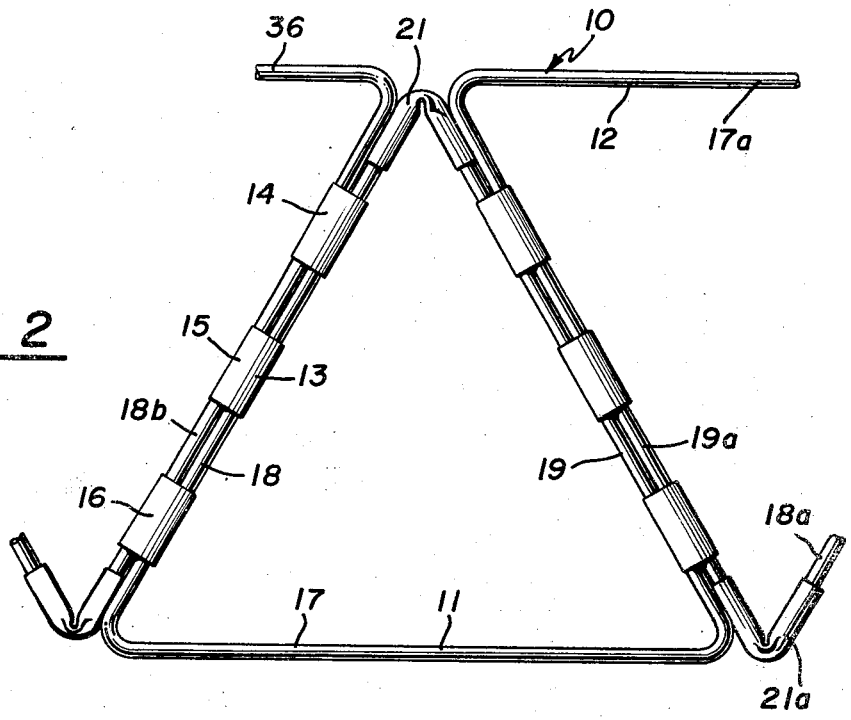
FIG. 2 is an enlarged elevational view of a portion of the apparatus.
Figure 3:
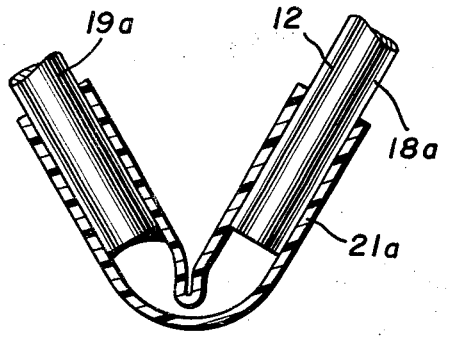
FIG. 3 is an enlarged sectional view of a still further portion of the apparatus.
Figure 4:
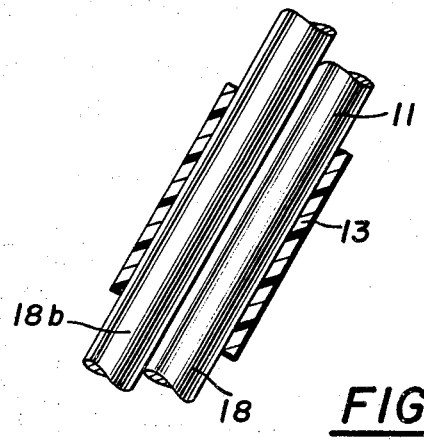
FIG. 4 is a sectional view of another portion of the apparatus.

Referring next to FIGS. 2, 3, and 4, which show the details of construction of the apparatus, the connecting means 13 is shown as consisting of a sleeve formed of an elastomeric material and the triangular element 11 is shown as in the form of an equilateral triangle bent from a single length of steel wire. More specifically, the connecting means 13 is shown as consisting of three elastomer sleeves 14, 15, and 16. The triangular element is bent to form three straight side members 17, 18, and 19, the free ends of the length of wire from which the triangle is formed being the ends of the sides 18 and 19 which, in turn, are joined by an elastomer connector sleeve 21. In FIG. 3, the side members **19*a* and 18*a* of the triangle 12 are shown joined by an elastomer sleeve 21*a*. In FIG. 4, the side 18 of the triangular element 11 is shown in contact with a side 18*b* of a triangular element 36. More specifically, the side members 17, 18, and 19 are formed from a single length of wire bent twice at 60° angles, the ends being joined at another 60° angle by the elastomer connector 21**.

Referring again to FIG. 1, it can be seen that a plurality of similar triangular elements 11, 12, 22, 23, 24, 25, 26, 27, 28, 29, 31, 32, 33, 34, 35, and 36 are joined in alternate or reversed arrangement to form an endless band. The hands 37 and 38 of the user are indicated in the drawing.

Figure 5:
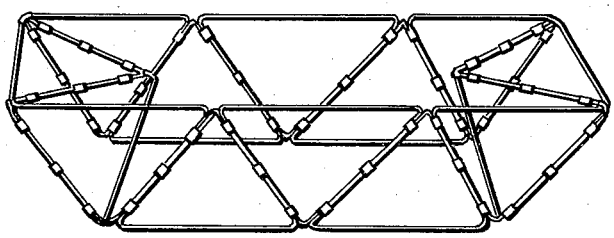
FIGS. 5, 6, and 7 show a selection of construction configurations into which the apparatus can be formed.
Figure 6:
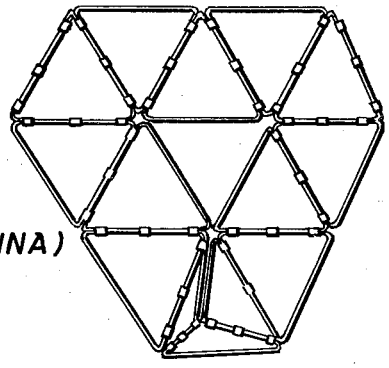
Figure 7:
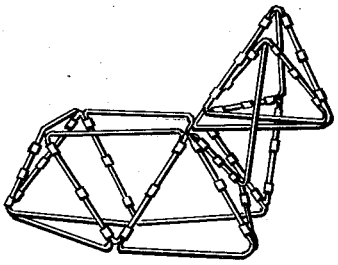

The operation and the advantages of the present invention will now be readily understood in view of the above description. As has been stated, the elements are formed into a loop which, when manipulated, can be changed into a number of interesting forms. Normally, the user would first place the apparatus in the general condition shown in FIG. 1 in which a rectangular fence configuration is formed. Triangular elements 23, 24, and 25 form one end of the fence, while the triangular elements 32, 33, and 34 form the other end of the rectangular fence. The user, by using his hands 37 and 38, can manipulate the apparatus into a wide variety of forms, starting with the initial fence-like configuration. For instance, the bridge shown in FIG. 5 can be formed by moving the upper apex of the triangular elements 24 and 33 downwardly until they rest on the table. This moves the triangular elements 25 and 23 inwardly at a 45° angle at one end and the triangular elements 32 and 34 inwardly in a similar way. The apparatus is then turned upside-down and the "bridge" results. The "radar antenna" shown in FIG. 6 is formed in a similar way by manipulating the apparatus and the "puppy" shown in FIG. 7 can be similarly formed. The number of interesting shapes that can be formed by the creative person is practically without limit.

It can be seen, then, that the present construction apparatus when used as a toy, has no loose parts that can become lost. Neither are there any sharp projecting parts or small parts that can be swallowed or can otherwise be damaging to a very young child. The use of the toy results in an educational exercise in three-dimensional visualization and this is done in such an interesting way that the user is hardly aware of its educational advantages. By use of the present apparatus, it is possible for the user to design a multitude of geometric forms, sculptures, and decorations by simply turning, rotating, or folding the triangles. It is very simple, of course, to add or subtract from the number of triangular elements in the band.

It is obvious that minor changes may be made in the form and construction of the invention without departing from the material spirit thereof. It is not, however, desired to confine the invention to the exact form therein shown and described, but it is desired to include all such as properly come within the scope claimed.

The invention having been thus described, what is claimed as new and desired to secure by Letters Patent is:

1. Construction apparatus, comprising:

(a) a first triangular element formed of a rod-like material, (b) a second triangular element similar to the first triangular element having one side in contact with one side of the first triangular element, (c) means connecting the two contacting sides, so as to permit relative rotation of the two triangular elements about an axis along the line of contacts of the said two sides, and (d) a plurality of similar triangular elements similarly rotatably joined in alternate arrangement to form an endless band.

2. Construction apparatus as recited in claim 1, wherein the said means is a sleeve formed of elastomeric material.

3. Construction apparatus as recited in claim 1, wherein the triangular elements are formed of steel wire.

4. Construction apparatus as recited in claim 1, wherein each triangular element consists of three straight wire side members and a tubular elastomeric connector joining the adjacent ends of at least two of said wire members.

5. Construction apparatus as recited in claim 1, wherein said connecting means comprises an elastomeric tube.

6. Construction apparatus, comprising:

(a) a first triangular element formed from a single length of wire bent twice to form two of the angles of a triangle, both free ends of the wire forming the third angle of the triangle, (b) an elastomeric connector joining the free ends of the wire to form the vertex of the third angle, (c) a second triangular element similar to the first triangular element having one side in contact with one side of the first triangular element, and (d) means connecting the two contacting sides, so as to permit relative rotation of the two triangular elements about an axis along the line of contacts of the said two sides.

* * * * *